US008834596B2

(12) United States Patent
Yakashiro et al.

(10) Patent No.: US 8,834,596 B2
(45) Date of Patent: Sep. 16, 2014

(54) METHOD FOR PRETREATING SINTERING MATERIAL

(75) Inventors: Kenichi Yakashiro, Kitakyushu (JP); Takeshi Imai, Kitakyushu (JP); Akira Gushima, Kitakyushu (JP); Tsuneo Ikeda, Kitakyushu (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 519 days.

(21) Appl. No.: 11/920,102

(22) PCT Filed: Nov. 11, 2005

(86) PCT No.: PCT/JP2005/021170

§ 371 (c)(1),
(2), (4) Date: Nov. 7, 2007

(87) PCT Pub. No.: WO2006/120773

PCT Pub. Date: Nov. 16, 2006

(65) Prior Publication Data

US 2009/0044662 A1 Feb. 19, 2009

(30) Foreign Application Priority Data

May 10, 2005 (JP) ..... 2005-137474

(51) Int. Cl.
*C22B 1/14* (2006.01)

(52) U.S. Cl.
USPC ..... 75/352; 75/772

(58) Field of Classification Search
USPC ..... 75/352, 772
See application file for complete search history.

(56) References Cited

U.S. PATENT DOCUMENTS

| | | | | |
|---|---|---|---|---|
| 2,831,574 | A * | 4/1958 | Weinig et al. | 209/166 |
| 4,134,944 | A | 1/1979 | Ilmoni et al. | |
| 5,009,707 | A | 4/1991 | Noda et al. | |
| 5,294,250 | A * | 3/1994 | Panigraphy et al. | 106/205.9 |
| 6,015,527 | A * | 1/2000 | Kamei et al. | 266/145 |
| 6,752,865 | B2 * | 6/2004 | Nayak et al. | 106/693 |

FOREIGN PATENT DOCUMENTS

| | | |
|---|---|---|
| CN | 1386136 | 12/2002 |
| EP | 0 383 079 | 8/1990 |
| GB | 1 092 551 | 11/1967 |
| JP | 53-123303 A | 10/1978 |
| JP | 04-080327 A | 3/1992 |
| JP | 11-61281 A | 3/1993 |

(Continued)

OTHER PUBLICATIONS

Machine translation Yatsugayo et al, JP 2000-290733, Oct. 2000.*
English Abstract of JP07166248A.*

*Primary Examiner* — Jie Yang
(74) *Attorney, Agent, or Firm* — Kenyon & Kenyon, LLP

(57) ABSTRACT

A method for pretreating a sintering material using as a material at least two types of iron ore containing coarse grains and fine powder, using a first granulator to make the fine powder stick to coarse grains forming core grains so as to produce S-type granules, and using a second granulator to granulate only fine powder or mainly fine powder to produce P-type granules, which method producing the S-type granules by adjusting an amount of fine powder supplied into said first granulator so that the average stuck thickness of fine powder to the core grains becomes 50 to 300 μm and supplying the remaining fine powder not supplied to said first granulator to the second granulator.

14 Claims, 3 Drawing Sheets

(56) References Cited

FOREIGN PATENT DOCUMENTS

| | | | | |
|---|---|---|---|---|
| JP | 07-062456 | 3/1995 | | |
| JP | 07166248 | A | * | 6/1995 |
| JP | 2000-290733 | A | | 10/2000 |
| WO | 01/92588 | | | 12/2001 |

* cited by examiner

METHOD FOR PRETREATING SINTERING MATERIAL

TECHNICAL FIELD

The present invention relates to a method for pretreating a sintering material.

BACKGROUND ART

Recently, in sintering machines, the supply of hematite and other iron ore used as the mainstream in the past has decreased, while the supply of iron ore with a high water of crystallization content (3 mass % or more) has increased. This iron ore of a high water of crystallization content has a great amount of fine powder compared to the iron ore used in the past, so when charging this iron ore into a sintering machine without pretreatment, the ventilation of the sintering machine is inhibited and it is not possible to productively produce sintered ore of a good quality.

Consequently, it is necessary to granulate the iron ore before charging it into the sintering machine, but there are the defects that the wettability with water is poor and the granulatability is low compared to the iron ore used in the past, so technology to granulate this has become necessary.

Usually, as a granulation technology, the method of making the fine powder stick to the coarse grains forming core grains (the granules formed by this method being referred to below as the "S-type granules") has been the mainstream, but the method of granulating only the fine powder or mainly the fine powder (the granules formed by this method being referred to below as the "P-type granules") has also been proposed.

For example, Japanese Patent Publication (A) No. 4-80327 discloses the technology of pulverizing iron ore and limestone so that the grains of 250 μm or less become 80 wt % or more and producing P-type granules in the presence of water. Further, Japanese Patent Publication (A) No. 53-123303 discloses the technology of granulating granules of iron ore two times to produce granules.

However, in the above conventional methods for pretreating sintering materials, there were the following problems which still should be solved.

The method disclosed in Japanese Patent Publication (A) No. 4-80327 requires that all of the limestone functioning as a binder be pulverized. This invites an increase of the production costs due to the pulverization and is not economical. The productivity of the granules is also extremely poor.

Further, with just making the pulverized grains of a size of 250 μm or less 80 wt % or more, it is not possible to raise the strength of the P-type granules produced up to the targeted strength. For example, when conveying the granules via a plurality of belt conveyors, the granules were liable to become powderized at the time of transfer.

The method disclosed in Japanese Patent Publication (A) No. 53-123303 may be able to improve the strength of the granules. However, for example, when preparing S-type granules, it is not possible to control the stuck thickness of the fine powder.

Consequently, if the stuck thickness is thick, the coke is buried inside the granules and it is difficult to produce a sintered ore providing the desired quality. This invites a drop in yield of the sintered ore and impairs the productivity of the sintered ore.

DISCLOSURE OF THE INVENTION

The present invention was made in consideration of this situation and has as its object to provide a method for pretreating a sintering material able to handle material of iron ore containing a larger amount of fine powder than in the past and furthermore able to produce granules having granulatability and strength improved over the past and produce sintered ore providing a good quality.

A method for pretreating a sintering material in line with the above object is a method for pretreating a sintering material using as a material at least two types of iron ore containing coarse grains and fine powder, using a first granulator to make the fine powder stick to coarse grains forming core grains so as to produce S-type granules, and using a second granulator to granulate only fine powder or mainly fine powder to produce P-type granules, characterized by producing the S-type granules by adjusting an amount of fine powder supplied into said first granulator so that the average stuck thickness of fine powder to the core grains becomes 50 to 300 μm and by using the remaining fine powder not supplied to said first granulator as material for the second granulator.

A method for pretreating a sintering material in line with the above object is a method for pretreating a sintering material using at least two types of iron ore containing coarse grains and fine powder as the material, using a first granulator to make the fine powder stick to coarse grains forming core grains so as to produce S-type granules, and using a second granulator to granulate only fine powder or mainly fine powder to produce P-type granules, characterized by producing the S-type granules by adjusting amount of coarse grains supplied into said first granulator so that the average stuck thickness of fine powder to the core grains becomes 50 to 300 μm.

Here, when producing the S-type granules comprised of the coarse grains forming core grains on which fine powder has been stuck, if the stuck thickness of the fine powder on the core grains (coarse grain iron ore or coarse grain coke) were increased, it would becomes difficult for the granules to be burned down to the insides and the productivity of the sintered ore by the sintering machine would deteriorate.

Further, when producing the P-type granules comprised of only fine powder or mainly fine powder granulated, to make the iron ore P-type granules, it would be necessary to pulverize all of it to the optimum grain size. This would place a tremendous load on the pulverization equipment and would not be realistic.

Therefore, in the method for pretreating a sintering material, the amount of the fine powder of the iron ore mixed into the first granulator is adjusted so as to enable the production of S-type granules having an optimum average stuck thickness of fine powder improving the productivity of sintered ore by the sintering machine, that is, an average thickness of 50 to 300 μm (preferably the upper limit is 250 μm, more preferably 220 μm) and the remaining part of the fine powder is used as the materials of the P-type granules.

Note that the adjustment of the amount of the fine powder mixed in includes a method of adjustment of not supplying fine powder to the first granulator.

Further, in the method for pretreating a sintering material, coarse grains forming the core grains of the iron ore are supplied to the first granulator so as to enable the production of S-type granules having an optimal average stuck thickness of the fine powder improving the productivity of sintered ore in the sintering machine, that is, an average thickness of 50 to 300 μm (preferably the upper limit is 250 μm, more preferably 220 μm).

At this time, by increasing the number of core grains relative to the amount of fine powder, the average stuck thickness of the fine powder can be made thinner than at the present time. Further, by decreasing the number of core grains relative to the amount of fine powder, the average stuck thickness of the fine powder can be made thicker than at the present time.

The method for pretreating a sintering material is a method characterized in that the coarse grains supplied to said first granulator include coarse grains in said iron ore from which the fine powder to be supplied to said second granulator is removed.

In the method for pretreating a sintering material, when separately treating at least two types of iron ore including coarse grains and fine powder in the first and the second granulators, the coarse grains in the iron ore not suited as material for the P-type granules produced by the second granulator can be used, without pulverization etc., as the core grains of the S-type granules produced by the first granulator.

The method for pretreating a sintering material in line with the above object is a method for pretreating a sintering material using as a material at least two types of iron ore containing coarse grains and fine powder, using a first granulator to make the fine powder stick to coarse grains forming core grains so as to produce S-type granules, and using a second granulator to granulate only fine powder or mainly fine powder to produce P-type granules, characterized by screening said iron ore supplied to said second granulator by a screen mesh of 0.5 to 10 mm, preferably, 0.5 to 7 mm (more preferably 0.5 to 2 mm), pulverizing the iron ore below the screen, adjusting the granules so that those under 500 μm (more preferably under 100 μm) become 40 mass % or more and under 22 μm become 5 mass % or more to obtain the material of said P-type granules and by supplying the iron ore on the screen together with the remainder of the iron ore not supplied to said second granulator to said first granulator.

To improve the productivity in the production of sintered ore by a sintering machine, it is necessary to secure the ventilation of the sintering machine.

Here, if the iron ore charged into the sintering machine has, for example, fine powder of 1 mm or less size mixed into it, the ventilation of the sintering machine is inhibited. Note that in the fine powder of 1 mm or less size, for example, the fine powder of 250 μm or less becomes fine powder sticking to the core grains of the S-type granules, so ventilation of the sintering machine can be prevented from being obstructed.

Further, in the fine powder of 1 mm or less, the fine powder of over 250 μm to 1 mm becomes intermediate grains not becoming the core grains or stuck fine powder of the S-type granules, so continue possibly causing obstruction of ventilation of the sintering machine, but conventional iron ore does not include a great amount of these intermediate grains, so the problem of and the problem of a drop in production of sintered ore in the sintering machine has not surfaced.

However, in the iron ore with a high water of crystallization content (3 mass % or more), whose supply has been increasing in recent years, the amount of fine powder is great, so the problem of a drop in production of sintered ore in the sintering machine has surfaced.

Therefore, in the method for pretreating a sintering material, for the purpose of improving the productivity of the sintered ore and, further, suppressing an increase in or decreasing the intermediate grains, the screen mesh was made the range of 0.5 to 10 mm (preferably the lower limit was made 0.8 mm, more preferably 1 mm).

This optimized the average stuck thickness of the fine powder of the S-type granules to improve the yield of the sintered ore and further pulverized the intermediate grains and used them as the material of the P-type granules to thereby improve the ventilation of the sintering machine.

Note that this screening does not have to be performed for all the iron ore supplied to the sintering machine. It is enough to apply it to at least one iron ore type or iron ore brand.

Further, the screening may be performed using a conventional known screen classifier and the like.

Further, the pulverization below the screen may be by any method so long as it reduces the grain size. For example, it is preferable use a roll pulverizer provided with a pair of rolls arranged adjoining each other a slight distance apart and pulverizing the material by the pressure of the rolls. In this case, the pressure of the rolls also has the effect of granulation in addition to pulverization.

If the iron ore below the screen after pulverization does not become the predetermined grain size distribution, for example, when the grains under 22 μm do not become 5 mass % or more, it is sufficient to separately add fine powder under 22 μm to adjust the grains. If addition is not necessary, the grains may be adjusted by just pulverization.

Above, in the method for pretreating a sintering material, for example, the iron ore containing the coarse grains and fine powder (also referred to as the "iron ore type"), for example, Marra Mamba ore (production area brand: West Angelas), Pisolite ore (production area brands: Yandi, Robe River), high phosphorous Brockman ore, and the like can be used. Note that, generally, if the production area brand differs, the ingredients and the grain size change, so a difference of the production area brand is considered in the present invention to mean a different iron ore type.

Further, as the first and second granulators, for example, a drum mixer, Eirich mixer, DIS granulator, Porsche mixer, or the like can be used.

The method for pretreating a sintering material is a method characterized by changing the size of said screen mesh in accordance with the average stuck thickness of fine powder of said S-type granules to make said average stuck thickness of the fine powder the desired predetermined range.

In the method for pretreating a sintering material, the desired predetermined range of the average stuck thickness of the fine powder is 50 to 300 μm, preferably is 50 to 250 μm, more preferably is 50 to 220 μm.

The method for pretreating a sintering material is a method characterized by changing the size of said screen mesh to change the amount of supply of the iron ore below said screen to said second granulator.

Due to this, production in accordance with the production capability of one or both of said second granulator and a pretreatment device provided before said second granulator is possible.

As a pretreatment device, there are, for example, a screen classifier, pulverizer, stirrer, and the like.

Here, by changing the size of the screen mesh, the amount of supply of the iron ore to the first and/or second granulator (for example, the ratio of supply of the iron ore) can be controlled. At this time, the grain size of the iron ore supplied to the first and/or second granulator can also be adjusted.

The method for pretreating a sintering material is a method characterized by pulverizing the fine powder forming the material of said P-type granules, adjusting the grains so that those under 500 μm become 90 mass % or more and under 22 μm become more than 80 mass %, and further granulating them in the presence of moisture.

The method for pretreating a sintering material is a method characterized by adjusting the pulverized iron ore below said screen so that the grains under 500 μm become 90 mass % or more and under 22 μm more than 80 mass % and further granulating them in the presence of moisture.

The method for pretreating a sintering material is a method characterized by pulverizing the material of said P-type granules and adjusting it so that the grains under 500 μm become 80 mass % or more and under 22 μm become over 70 mass % to 80 mass % and further granulating it in the presence of moisture, then drying it.

The method for pretreating a sintering material is a method characterized by adjusting pulverized iron ore below said screen so that the grains under 500 μm become 80 mass % or more and under 22 μm become over 70 mass % to 80 mass % and further granulating it in the presence of moisture, then drying it.

The method for pretreating a sintering material is the method characterized by pulverizing the material of said P-type granules, adjusting it so that the grains under 500 μm become 40 mass % or more and under 22 μm become 5 mass % to 70 mass %, and further granulating it in the presence of moisture and a binder, then drying it.

The method for pretreating a sintering material is a method characterized by adjusting the pulverized iron ore below said screen so that the grains under 500 μm become 40 mass % or more and under 22 μm become 5 mass % to 70 mass % and, further, granulating it in the presence of moisture and a binder, then drying the granules.

Above, in the method for pretreating a sintering material, the P-type granules are granulated using as a material only fine powder or mainly fine powder, so it is necessary to make the strength (crushing strength) of the P-type granules stronger to a suitable value.

For example, the granules are conveyed using a plurality of belt conveyors. The granules are powderized at the transfer points. This is charged into the sintering machine where it is liable to obstruct the ventilation of the sintering machine. Further, the granules are liable to crumble in the granules of the sintering machine and obstruct the ventilation.

Under these circumstances, the P-type granules would appear more prominently than even the S-type granules, so some measure must be taken in the P-type granules.

Generally, when granulating fine grains in the presence of a liquid, it is known that from the formula of RumPf that the strength of the granules depends on the surface tension of the liquid (the larger, the stronger) and the grain size (the smaller, the stronger).

The inventors, in addition to the above known matter, newly focused on the extremely fine grains contained in the grains of the iron ore and newly discovered that these remarkably fine grains can be effectively utilized to improve the strength of the granules.

The inventors investigated the 50 μm to 1 mm iron ore grains of iron ore of a high water of crystallization content (3 mass % or more) recently increasing in supply and learned that there are iron ore types containing a large amount of extremely fine grains of a grain size from under 22 μm to the submicron class (for example, Marra Mamba ore, high phosphorous Brockman ore, and the like).

Due to this, they pulverized and adjusted the above iron ore in order to take out the extremely fine grains included and made a grain size distribution where (a) the grains under 500 μm become 40 mass % or more and under 22 μm become 5 mass % or more, (b) preferably the grains under 500 μm become 80 mass % or more and under 22 μm become over 70 mass %, (c) more preferably the grains under 500 μm become 90 mass % or more and under 22 μm become over 80 mass %, it is possible to ensure the presence of extremely fine grains, granulize them through water, and further improve the strength of the granules.

Note that an improvement of strength by said extremely fine grains is realized if the grains of a size under 500 μm become 80 mass % or more and under 22 μm become over 70 mass % to 80 mass %, but particularly if the grain size is small, a further improvement in strength can be expected.

Therefore, in the method for pretreating a sintering material, by making the grain size of the iron ore one so that grains under 500 μm become 90 mass % or more and under 22 μm become over 80 mass % and granulating the grains in the presence of moisture, the desired strength can be obtained.

Further, in the method for pretreating a sintering material, the rise in the average grain size due to making the grain size of the iron ore one so that grains under 500 μm become 80 mass % or more and under 22 μm become over 70 mass % to 80 mass % is compensated for by the drying performed after granulation in the presence of moisture so as to further improve the strength.

Further, in the method for pretreating a sintering material, the rise in the average grain size due to making the grain size of iron ore one so that grains under 500 μm become 40 mass % or more and under 22 μm become 5 mass % to 70 mass % is compensated for by using the moisture and the binder and compensated for by drying after granulating this so as to further improve the strength.

Note that the binder contributes to the improvement of the strength of the granules, but conventional quicklime, limestone, and other inorganic material-based binders must be pulverized in order to be mixed with the granules.

On the other hand, for example, it is more preferable to use pulp spent liquor, cornstarch, and other aqueous solutions or colloid organic matter, a dispersant promoting solid cross-liking (including aqueous solutions or colloids to which a dispersant is added), or the like as a binder (including joint use with said inorganic based binders).

The dispersant referred to here may be any one by which addition together with water at the time of the granulation of the sintering material gives the action of promoting dispersion of ultrafine grains of 10μ or less contained in the sintering material in the moisture. It is not limited to inorganic compounds, organic compounds, low molecular weight compounds, or high molecular weight compounds. While it is not particularly limited, high molecular weight compounds having acid groups and/or their salts are preferred.

Among these, sodium polyacrylate or ammonium polyacrylate having a weight average molecular weight of 1000 to 100,000 has a high ability to disperse the fine grains and is inexpensive cost-wise, so is most preferably used.

The method for pretreating a sintering material is a method, characterized by making a drying temperature of said P-type granules 40° C. to 250° C. In the method for pretreating a sintering material, the iron ore of the material of the P-type granules used is for example one having a high water of crystallization content (3 mass % or more), so a drying temperature suppressing and further preventing the breakdown of the crystallization water is set.

As the iron ore with a water of crystallization content of 3 mass % or more, there are, for example, Marra Mamba ore, Pisolite ore, high phosphorous Brockman ore, and the like. In granules of iron ore with a high water of crystallization content (3 mass % or more), if the crystallization water breaks down, the granules crumble and powderize.

Consequently, in the method for pretreating a sintering material, the lower limit of the drying temperature is made 40° C., preferably 100° C., and the upper limit is made 250° C., preferably 240° C., more preferably the theoretical temperature where the crystallization water breaks down, that is, 239° C.

The method for pretreating a sintering material is a method characterized in that the size of said P-type granules is in the range of 1 to 10 mm.

In the method for pretreating a sintering material, if the size of the P-type granules is in excess of 10 mm, at the time of production of the sintered ore, the P-type granules will not be able to be sintered down to their centers and the quality of the sintered ore will deteriorate. On the other hand, if the size of the P-type granules is less than 1 mm, the granules will be densely packed when charged into the sintering machine and no improvement of the ventilation of the sintering machine will be expected.

Therefore, by setting the lower limit of the size of the P-type granules to 1 mm, preferably 2 mm, more preferably 3 mm, and setting the upper limit to 10 mm, preferably 9 mm, more preferably to 8 mm, it becomes possible to suitably sinter the P-type granules in the sintering machine down to their insides and produce sintered ore of a good quality.

A method for pretreating a sintering material is a method characterized in that said material further has an iron-containing material comprised of substantially only fine powder added to it.

In the method for pretreating a sintering material, as the iron-containing material comprising only fine powder, for example dust having a grain size of 100 μm or less (mixed dust and coarse dust), a granule material of 250 μm or less (Granule Feed: PF), and the like may be used.

The method for pretreating a sintering material in line with the above object is a method characterized by using iron ore with a water of crystallization content of 3 mass % or more for part or all of the material.

In the method for pretreating a sintering material, as iron ore with a water of crystallization content of 3 mass % or more, for example, Marra Mamba ore (production area brand: West Angelas), Pisolite ore (production area brand: Yondi, Robe River), high phosphorous Brockman ore, and the like may be used. Note that, generally, if the production area brand differs, the ingredients and the grain size change, so a difference of the production area brand may be treated to mean a different iron ore type.

Further, when using iron ore with a water of crystallization content of 3 mass % or more, among the new materials of iron ore (except returned ore used as material after being passed through sintering machine etc.), it may be made iron ore of which 40 mass % or more has a water of crystallization content of 3 mass % or more.

If the ratio of the iron ore becomes 40 mass % or more, the increase of the fine powder becomes remarkable and the effect of the invention becomes remarkable. If less than 40 mass %, the invention has an effect, but it is not remarkable.

The method for pretreating a sintering material depending on this adjusts the amount of fine powder mixed into the first granulator so that the average stuck thickness of the fine powder to the core grains of the S-type granules is optimized, so it is possible to produce a sintered ore provided with a good quality.

Further, because the remaining part of the fine powder not supplied to the first granulator is used as the material of the second granulator, granules which have granulatability and strength improved over the past can be easily produced.

In this way, according to the present invention, a method for pretreating a sintering material which can handle material of iron ore containing a larger amount of fine powder than in the past can be provided.

The method for pretreating a sintering material depending on the same adjust the amount of the fine powder mixed in the first granulator so that the average stuck thickness of the fine powder to the core grains of the S-type granules is optimized, so it is possible to handle material of iron ore containing a larger amount of fine powder than in the past and possible to produce a sintered ore provided with good quality.

In particular, the method for pretreating a sintering material supplies to the first granulator the coarse grains in the iron ore from which the fine powder to be supplied to the second granulator producing the P-type granules has been removed, so it is possible to use iron ore of a grain size suitable for the production of S-type granules and P-type granules without for example pulverization or the like and produce the granules economically.

The method for pretreating a sintering material depending on it uses screened iron ore on a screen to optimize the average stuck thickness of the fine powder in the S-type granules and can improve the yield of the sintered ore. Further, by pulverizing and adjusting the screened iron ore below the screen and by using it for the material of the P-type granules, the ventilation of the sintering machine can be improved.

The method for pretreating a sintering material changes the size of the screen mesh in accordance with the average stuck thickness of the fine powder of the S-type granules, so for example, even if a change of the grain size distribution of the iron ore used occurs, it is possible to easily produce granules enabling improvement of the ventilation of the sintering machine.

The method for pretreating a sintering material changes the size of the screen mesh and changes the amount of supply of the iron ore below the screen to the second granulator, so for example production of the P-type granules in accordance with the production capabilities of the second granulator and the pretreatment devices is possible and, even when a change of the grain size distribution of the iron ore used occurs, P-type granules can be stably produced.

The method for pretreating a sintering material make the grain size of the iron ore one where grains under 500 μm become 90 mass or more and under 22 μm become over 80 mass % and granulate the ore in the presence of moisture, so it is possible to use the surface tension of a liquid and grain size to produce P-type granules provided with the desired strength.

The method for pretreating a sintering material makes up for the rise in the average grain size due to making the grain size of the iron ore one where grains under 500 μm become 80 mass % or more and under 22 μm become over 70 mass % to 80 mass % by drying the material after granulating it in the presence of moisture, so it is possible to produce P-type granules achieving a further improvement of strength.

The method for pretreating a sintering material makes up for the rise in the average grain size due to making the grain size of the iron ore one where grains under 500 μm become 40 mass % or more and under 22 μm become 5 mass % to 70 mass % by using moisture and a binder and makes up for it by drying after granulating the material so it is possible to produce P-type granules achieving a further improvement of strength.

The method for pretreating a sintering material makes the drying temperature 40° C. to 250° C., so can suppress and further prevent the breakdown of the crystallization water and suppress and further prevent the crumbling and powdering of the granules.

The method for pretreating a sintering material sets the size of the P-type granules in the range of 1 to 10 mm, so it becomes possible to suitably sinter the P-type granules in a sintering machine down to the inside and produce sintered ore of a good quality and possible to improve the yield of the sintered ore over the past.

The method for pretreating a sintering material enables fine powder which tended to be restricted in amount used in the past, for example, dust, granule materials, and other iron ores to be used without restriction.

BEST MODE FOR CARRYING OUT THE INVENTION

Figure 2:
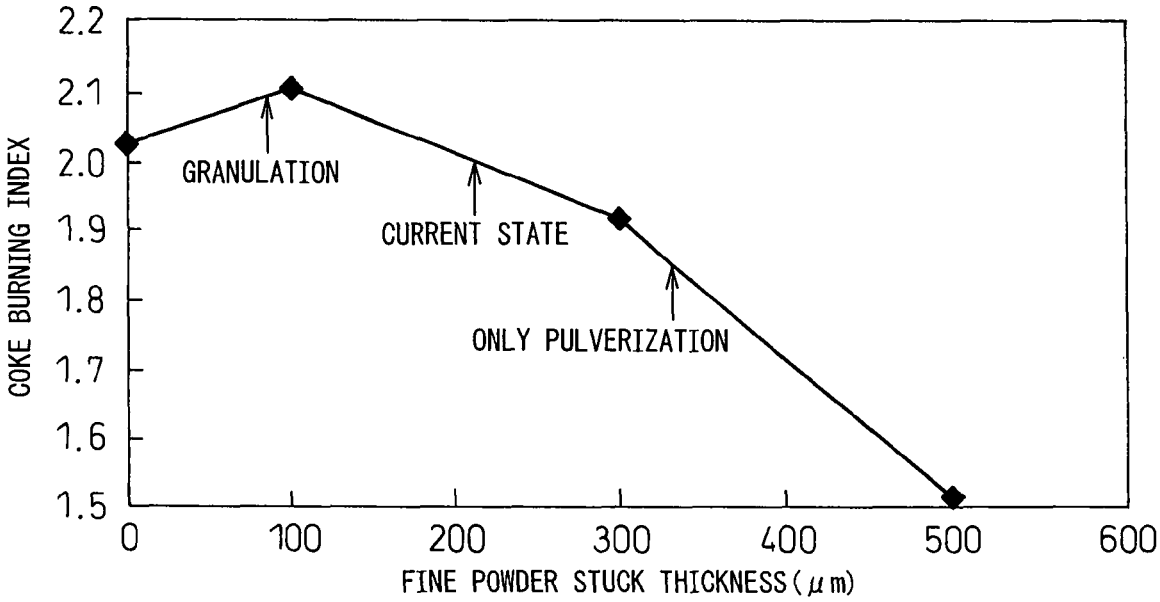
FIG. 2 is a view showing the effect of the fine powder stuck thickness of the S-type granules on a coke burning index.
Figure 3:
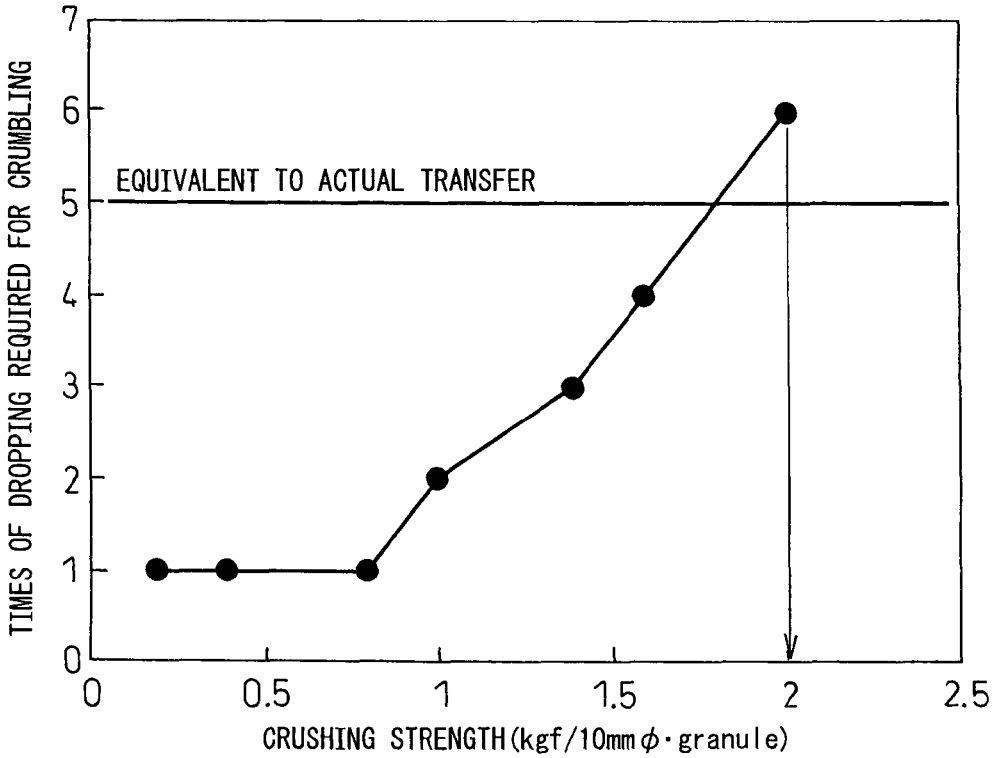
FIG. 3 is a view showing the crushing strength required to suppress crumbling of the P-type granules.
Figure 4:
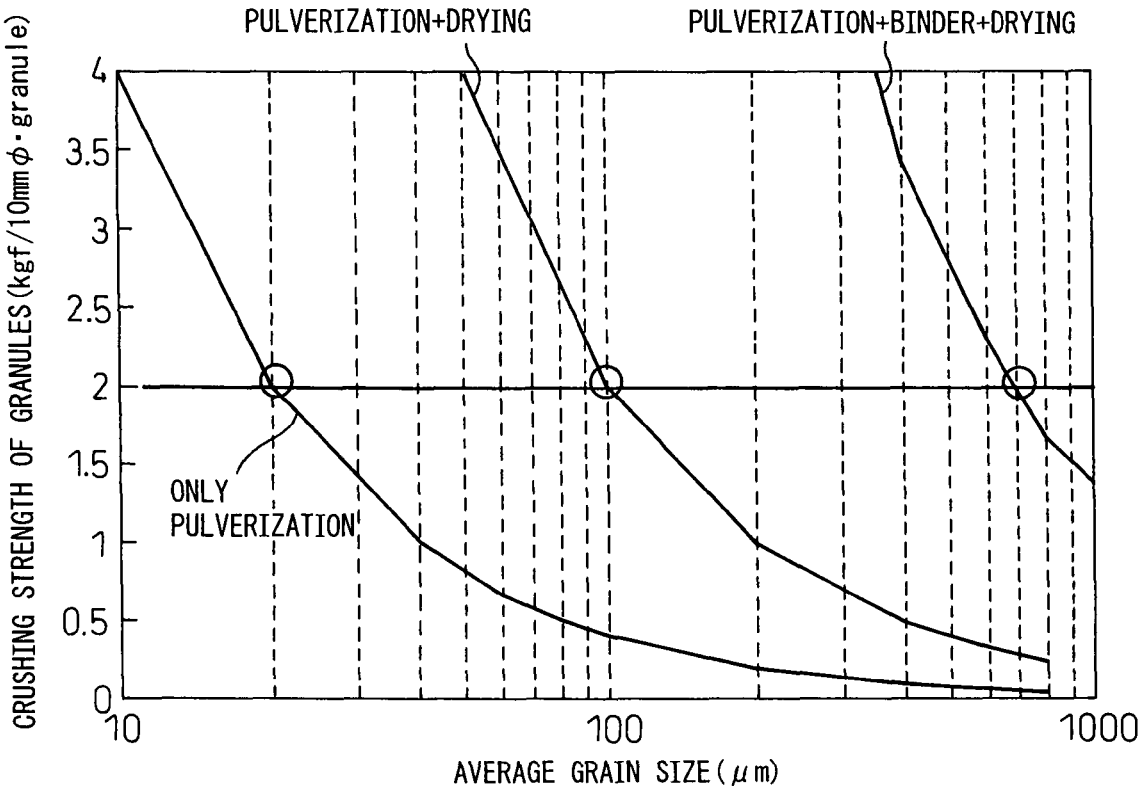
FIG. 4 is a view showing the effect of the production conditions of the P-type granules on the crushing strength.

While referring to the attached drawings, an embodiment of the present invention will be explained and used for understanding the present invention. Here, FIG. 1 is a view for explaining the method for pretreating a sintering material according to an embodiment of the present invention, FIG. 2 is a view showing the effect of the fine powder stuck thickness of the S-type granules on a coke burning index, FIG. 3 is a view showing the crushing strength required to suppress crumbling of the P-type granules, and FIG. 4 is a view showing the effect of the production conditions of the P-type granules on the crushing strength.

Figure 1:
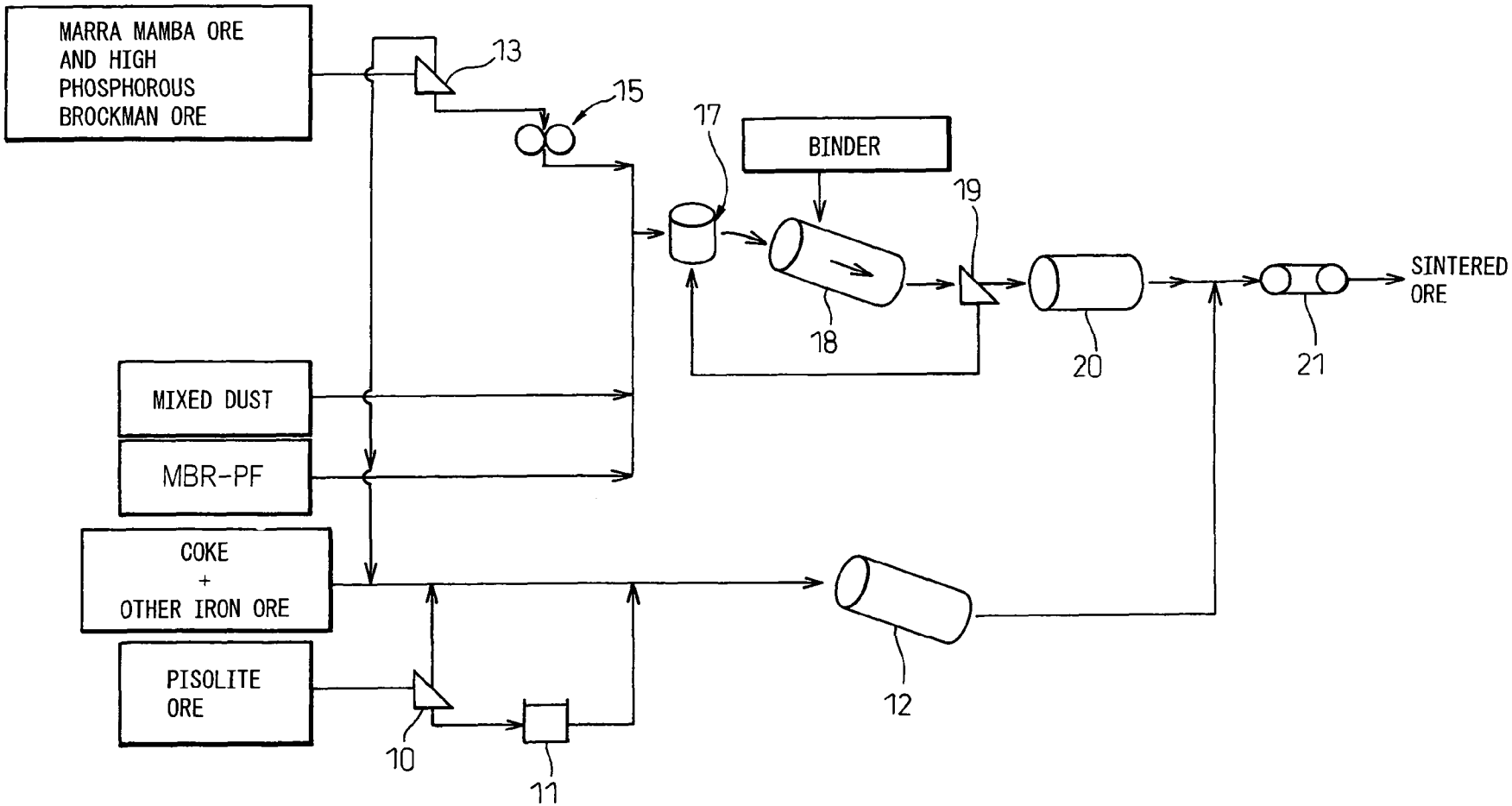
FIG. 1 is a view for explaining the method for pretreating a sintering material according to an embodiment of the present invention.

As shown in FIG. 1, a method for pretreating a sintering material according to an embodiment of the present invention is a method using three types of iron ore containing coarse grains and fine powder, that is, Pisolite ore, Marra Mamba ore, and high phosphorous Brockman ore as the material for producing S-type granules comprising coarse grains forming core grains to which fine powder is stuck and P-type granules granulated using mainly fine powder.

Note that the material further has iron ore comprised of substantially only fine powder, that is, mixed dust generated in the ironmaking plate, granule feed (ore type: MBR-PF), and other iron ore added to it. Below, this will be explained in detail.

Marra Mamba ore, Pisolite ore, and high phosphorous Brockman ore are together called brown hematite ($Fe_2O_3$-$nH_2O$) and is iron ore with a water of crystallization content of 3 mass % or more. For example, it has from coarse grains of about 10 mm (in this embodiment, about 8 mm) to fine powder of 250 μm or less.

This Pisolite ore, coke dust, other iron ores, and limestone are used to produce S-type granules, while the Marra Mamba ore, high phosphorous Brockman ore, mixed dust, and granule feed are used to produce P-type granules.

First, the method of production of the S-type granules will be explained.

As shown in FIG. 1, the Pisolite ore containing the coarse grains and fine powder is screened by the screen classifier 10. Note that, in the present embodiment, a screen classifier 10 with a screen mesh of 3 mm was used, but the invention is not limited to this.

The screened iron ore on the screen which is the coarse grains, so is used as the core grain in that state without being treated. On the other hand, the iron ore below the screen is charged into an Eirich mixer 11 and for example kneaded with limestone or another binders and the like to be granulated.

The kneaded granules are charged together with the coke dust, other iron ore, and limestone into an S-type use drum mixer (one example of the first granulator) 12 where the fine powder (for example, 250 μm or less) contained in the coke dust, other iron ore, and limestone sticks to the circumferences of the core grains.

Due to this, S-type granules with an average thickness of the fine powder stuck to the circumferences of the core grains of 50 to 300 μm are produced. Note that, at the time of production of the S-type granules, part of the grains with a grain size exceeding 250 μm contained in the coke dust, other iron ore, and limestone are discharged along with the S-type granules from inside the S-type use drum mixer 12.

Here, the reason for limiting the average stuck thickness of the fine powder of the S-type granules to a range of 50 to 300 μm will be explained while referring to FIG. 2.

The average stuck thickness of the fine powder on the abscissa of FIG. 2 is calculated by the following procedure using the produced S-type granules.

(1) First, the material concerned was completely separated into fine powder and coarse grains and other grains by water washing and the like, screened successively using screens of a screen mesh of 5 mm, 2 mm, 1 mm, 0.5 mm, and 0.25 mm, and measured for weight ratio of the different grain size ranges (weight g of different grain size ranges when using total as 100 g).

(2) Representative grain sizes of the ranges of the core grains of 5 mm or more, less than 5 mm to 2 mm, and less than 2 mm to 1 mm (respectively 7.5 mm, 3.5 mm, and 1.5 mm) were set and the numbers of core grains of the different representative grain sizes were calculated from the weight ratios of the different grain size ranges against the total as 100 g. At this time, the core grain density was made 4 g/cm$^3$.

(3) When dividing the fine powder of 0.25 mm or less forming the powder stuck to the core grains for the different core grain ranges, the weights of the fine powder divided for the different grain size ranges were determined in proportion to the weight ratios of the core grains of the different core grain ranges.

(4) The stuck thicknesses of the core grains were calculated from the numbers of grains of the representative grain sizes of the different ranges of the core grains calculated at (2) and the weights of the fine powder divided calculated and determined at (3). At this time, the bulk density of the stuck powder layer was made 2 g/cm$^3$.

(5) Further, the stuck powder thicknesses of the different core grain ranges were weight averaged by the weight ratios of the different grain size ranges to obtain the average stuck thickness of the fine powder.

The coke burning index on the ordinate of FIG. 2 corresponds to the yield of the sintered ore obtained by sintering the S-type granules. As the coke burning index becomes higher, the yield of the sintered ore also improves.

FIG. 2 shows the relationship of the fine powder stuck thickness (μm) and the coke burning index in a test granulating materials with grain size distributions variously changed, then sintering them by a pot test.

As shown in FIG. 2, the coke burning index tends to rise along with an increase in thickness until the fine powder stuck thickness becomes 100 μm, then falls along with an increase of the thickness.

In the above way, giving consideration so as not to cause a deterioration of the yield rate of the sintered ore, the average stuck thickness of the fine powder is restricted to 50 to 300 μm, preferably the upper limit is made 250 μm, more preferably is made 220 μm.

Based on the above discovery, the inventors prepared three types of S-type granules of ones being used for current operations and having an average stuck thickness of fine powder of 204 μm (current), ones with a thinner stuck thickness than this of 88 μm, and ones with a thicker stuck thickness of 327 μm, charged these S-type granule into sintering machines, and examine their effects on the sintered ore yield.

Note that the different S-type granules were produced using constant weights of the iron ore materials, so the 327 μm S-type granules (only pulverized) were produced and charged into the sintering machine by making up for the insufficient amount of fine powder by pulverizing iron ore and making it stick to the circumferences of the core grains, while the 88 μm S-type granules were charged into the sintering machine together with P-type granules (granules) produced by granulating the remaining part of the fine powder not used for the S-type granules.

Here, the results of the examination for the 88 μm S-type granules are not results of only the S-type granules, but the amount of the P-type granules mixed in is small (for example, about 20 to 30 mass % of the total amount of the S-type granules and P-type granules) and, furthermore, coke dust becoming a heat source is not included in the P-type granules, so the obtained results are believed to substantially correspond to the results of the S-type granules.

As a result of the examination conducted under the above assumptions, sintered ore yields along the coke burning index of the results of the pot test in FIG. 2 were obtained.

Next, the method of production of the P-type granules will be explained.

As shown in FIG. 1, Marra Mamba ore and high phosphorous Brockman ore containing coarse grains and fine powder are screened by the screen classifier 13. Note that, the screen mesh of the screen classifier 13 was set in the range of 0.5 to 10 mm (3 mm in the present embodiment).

The iron ore below the screen screened by the screen classifier 13 is charged into the kneader 17 together with the mixed dust and granule feed (MBR-PF) pulverized by the pulverizer 15 and blended. Note that the screen classifier 13 and pulverizer 15 configure the pretreatment devices.

The later treatment is performed in accordance with the grain size distribution resulting from the pulverization and adjustment of the iron ore used in order to produce the P-type granules at this time.

When pulverizing the iron ore below the screen forming the material of the P-type granules and adjusting it so that the grains under 500 μm become 90 mass % or more and under 22 μm exceed 80 mass %, this is charged in the P-type use drum mixer (one example of the second granulator) 18, water (for example, 5 to 15 mass % in terms of external content) is used for granulation, then the result is screened by the screen classifier 19.

Further, when pulverizing the iron ore below the screen forming the material of the P-type granules and adjusting it so that the grains under 500 μm become 80 mass % or more and under 22 μm exceed 70 mass % to 80 mass %, this is charged in the P-type drum mixer 18, water (for example, 5 to 15 mass % in terms of external content) is used for granulation, then the result is screened by the screen classifier 19 and further dried by the dryer 20.

Then, when pulverizing the iron ore below the screen forming the material of the P-type granules and adjusting it so that the grains under 500 μm become 40 mass % or more and under 22 μm become 5 mass % to 70 mass %, this is charged in the P-type drum mixer 18, for example, pulp spent liquor, cornstarch, or another organic binder (for example, preferably made 0.01 to 3 mass % in terms of external content, more preferably 0.1 to 3 mass %) and water (for example, 5 to 15 mass % in terms of external content) are used for granulation, then the result is screened by the screen classifier 19 and further dried by the dryer 20.

Note that the drying is performed in an atmosphere set from 40° C. to 250° C., for example, for 20 to 60 minutes or so. Further, when measuring the mass % of fine powder grains under 500 μm, under 22 μm, and the like, a laser diffraction-scattering method measuring device (MICROTRAC FRA manufactured by Nikkiso Co., Ltd., measurement range: 0.1 to 700 μm) was used.

Here, the reasons for changing the later treatment in accordance with the grain size distribution resulting from pulverization and adjustment of the iron ore will be explained.

When using fine powder as the material of the P-type granules (below referred to as the "granules"), the strength (crushing strength) of the P-type granules is low, so it is necessary to raise the strength to a suitable value. Consequently, if setting the strength required in the P-type granules considering to provide enough of a strength so that no problems occur even with five or more transfers between belt conveyors (not shown) (corresponding to actual transfers between conveyors), as shown in FIG. 3, it is understood that a strength of 2 kgf per P-type granule of 10 mm diameter (2 kgf/10 mmf-granule) or more is necessary.

Therefore, a method of treatment satisfying 2 kgf/10 mmf-granule or more will be explained with reference to FIG. 4. Note that the materials used were Marra Mamba ore pulverized to 3 mm or less, granule feed, and mixed dust.

As shown in FIG. 4, among (1) only pulverization, (2) pulverization and drying, (3) pulverization, drying, and addition of a binder, at the same average grain size, the trend of the crushing strength of the granules rise in the order of (1)→(2)→(3) was obtained.

Note that the moisture used for the granulation was 10 mass % in terms of external content, the amount of the binder (pulp spent liquor) added was 1 mass % by external content, the drying was performed at 250° C. for 30 minutes, and the moisture contained in the granules was reduced to 5 mass % by external content.

Here, when only pulverizing the iron ore, if the average grain size is 20 μm or less (grains under 500 μm becoming 90 mass % or more and under 22 μm exceeding 80 mass %), the produced granules can satisfy the condition of 2 kgf/10 mmf-granule or more.

Further, when further drying the granules, even if the average grain size is increased and made 100 μm or less (grains under 500 μm becoming 80 mass % or more and under 22 μm becoming more than 70 mass % to 80 mass %), the produced granules can satisfy the condition of 2 kgf/10 mmf-granule or more.

Further, when drying the granules to which a binder was added, even if the average grain size is further increased to 700 μm or less (grains under 500 μm becoming 40 mass % or more and under 22 μm 5 mass % to 70 mass %), the produced granules can satisfy the condition of 2 kgf/10 mmf-granule or more.

From the above, the above treatments were administered depending on the pulverized grain size.

The screen mesh of the screen classifier 19 screening the granules granulated by the P-type use drum mixer 18 was adjusted to enable screening of granules in the range of a grain size of 1 to 10 mm.

Note that the granules of a grain size of less than 1 mm are once again charged into the kneader 17 without being treated, while the granules with a grain size exceeding 10 mm are crushed by a crusher (not shown), again charged into the kneader 17, and adjusted in size.

The granules adjusted in grain size to the range of 1 to 10 mm in the above way, as described above, were dried in accordance with need and became the P-type granules.

Note that when producing the P-type granules, the iron ore on the screen resulted from screening Marra Mamba ore and high phosphorous Brockman ore by a screen mesh set in the range of 0.5 to 10 mm of the screen classifier 13 is not suitable as material of the P-type granules.

This, as stated above, is because if not pulverizing the material, strength of the produced P-type granules is difficult to secure, the load of pulverization is larger relative to the iron ore below the screen, and a load is placed on the operation.

Therefore, the iron ore on the screen is mainly used as the core grains of the S-type granules without being pulverized.

In this way, in the fine powder included in the Marra Mamba ore and high phosphorous Brockman ore, the screen mesh of the screen classifier 13 is used to adjust the amount of the fine powder mixed in, that is, adjust it to a state not supplying it to the S-type use drum mixer 12. The remaining part prevented from being supplied to the S-type use drum mixer 12 as much as possible, that is, substantially all of the fine powder, is used as the material of the P-type use drum mixer 18.

Here, the screen mesh of the screen classifier 13 is changed in size according to the average stuck thickness of the fine powder of the S-type granules. By adjusting the amount of the coarse grains in the iron ore, from which the fine powder to be supplied to the P-type use drum mixer 18 has been removed, mixed into the S-type use drum mixer 12, it is possible to make the average stuck thickness of the fine powder the desired predetermined range of 50 to 300 μm.

For example, when a change of the grain size distribution of the iron ore used results in an increase in the average stuck thickness of the fine powder of the S-type granules, a screen mesh in a range of 1 mm or more and close to 1 mm may be used to increase the amount of core grains of the S-type granules supplied to the S-type use drum mixer 12 so as to optimize the average stuck thickness of the fine powder.

On the other hand, for example, when a change of the grain size distribution of the iron ore results in a decrease in the average stuck thickness of the fine powder of the S-type granules, a screen mesh close to 10 mm may be used to decrease the amount of core grains of the S-type granules supplied to the S-type use drum mixer 12 so as to optimize the average stuck thickness of the fine powder.

Further, the screen mesh of the screen classifier 13 can be changed in size in accordance with the production capability of either one or both of the P-type use drum mixer 18 and pretreatment devices so as to control (change) the amount of supply of the iron ore to each device.

For example, when a change of the grain size distribution of the iron ore used results in an extra margin in the production capabilities of the devices producing the P-type granules, a screen mesh close to 10 mm may be used to increase the amount of supply of the materials for producing the P-type granules.

On the other hand, for example, when a change of the grain size distribution of the iron ore used results in a shortage in the production capabilities of the devices producing the P-type granules, a screen mesh close to 0.5 mm may be used to decrease the amount of supply of the materials for producing the P-type granules.

At this time, when temporarily stocking the iron ore below the screen and there is an extra margin in the capabilities of the devices producing the P-type granules, treatment of the stocked iron ore and other measures may be taken in accordance with need.

Further, when adjusting the screen mesh of the screen classifier 13, intermediate grains difficult to become fine grains contained in the iron ore on the screen (for example, over 250 μm to 1 mm) often are discharged from the S-type use drum mixer 12 without sticking to the S-type granules. Note that the intermediate grains may be pulverized and used as material of the P-type granules or may be used as the stuck fine powder of the S-type granules.

The S-type granules and P-type granules produced by the above method are charged in the sintering machine 21 in layers without mixing, so that for example 70 to 80 mass % of the total amount becomes S-type granules, to produce the sintered ore.

Because of this, it is possible to handle a material of iron ore including a larger amount of fine powder than in the past and possible to produce granules improved in granulatability and strength over the past and produce sintered ore provided with good quality.

Above, the present invention was explained referring to an embodiment, but the present invention is not limited in any way to the configuration described in the aforementioned embodiment and includes other embodiments and modifications conceivable in the range of the matters described in the claims.

For example, cases of combining part or all of the above embodiment or its modifications to configure a method for pretreating a sintering material of the present invention are also included in the scope of the present invention.

Further, in the above embodiment, as the three types of iron ore containing coarse grains and fine powder, the case of use of Pisolite ore, Marra Mamba ore, and high phosphorous Brockman ore was explained, but any two or more types of iron ore containing coarse grains and fine powder may be used. For example, use of Pisolite ore and Marra Mamba ore or use of another iron ore, for example, magnetite ($Fe_3O_4$), hematite ($Fe_2O_3$), and the like is also possible.

Note that these iron ores may of course have other iron sources, for example, iron sources generated in the ironmaking plant etc. added to it to form the materials.

Then, in the above embodiment, at the time of production of the P-type granules, when making the grain size after pulverization and adjustment of the fine powder one where the grains under 500 μm become 90 mass % or more and under 22 μm exceed 80 mass %, the material was granulated without adding a binder and was charged into the sintering machine without drying, but it is possible to either or both add a binder and dry the material according to need.

Further, when making the grain size after pulverization and adjustment of the fine powder one where grains under 500 μm became 80 mass % or more and under 22 μm became over 70 mass % to 80 mass %, the material was granulated without adding a binder, then dried and charged into the sintering machine, but it is possible to add a binder according to need.

INDUSTRIAL APPLICABILITY

The present invention can utilize iron ore including a larger amount of fine powder than in the past as a sintering material, so has great applicability in the ferrous metal industry.

The invention claimed is:

1. A method for pretreating a sintering material comprising at least two types of iron ore containing coarse grains and fine powder, wherein the at least two types of iron ore each has a water of crystallization content of 3 mass % or more, said method comprising the steps of:

producing S-type granules using said coarse grains as core grains and an amount of said fine powder in a first granulator, wherein said amount of said fine powder is adjusted so that the S-type granules have an average stuck thickness of fine powder to the core grains of 50 to 300 μm, and producing P-type granules using the remaining fine powder not supplied to said first granulator using a second granulator by a method comprising pulverizing the fine powder forming the material for the second granulator, adjusting the grains so that grains under 500 μm become 90 mass % or more and grains under 22 μm become more than 80 mass %, and granulating the grains in the presence of moisture in the second granulator.

2. A method for pretreating a sintering material as set forth in claim 1, wherein the size of said P-type granules is in a range of 1 to 10 mm.

3. A method for pretreating a sintering material as set forth in claim 1, wherein said material further comprises an added iron-containing material comprising substantially only fine powder.

4. A method for pretreating a sintering material comprising at least two types of iron ore containing coarse grains and fine powder, wherein the at least two types of iron ore each has a water of crystallization content of 3 mass % or more, said method comprising the steps of:

producing S-type granules using an amount of said coarse grains as core grains and an amount of said fine powder in a first granulator, wherein said amount of said coarse grains is adjusted so that the S-type granules have an average stuck thickness of fine powder to the core grains of 50 to 300 μm, and producing P-type granules using the remaining fine powder using a second granulator by a method comprising pulverizing the fine powder forming the material for the second granulator, adjusting the grains so that grains under 500 μm become 90 mass % or more and grains under 22 μm become more than 80 mass %, and granulating the grains in the presence of moisture in the second granulator.

5. A method for pretreating a sintering material as set forth in claim 4, wherein the coarse grains supplied to said first granulator include coarse grains of said iron ore from which the fine powder supplied to said second granulator is removed.

6. A method for pretreating a sintering material comprising at least two types of iron ore containing coarse grains and fine powder, wherein the at least two types of iron ore each has a water of crystallization content of 3 mass % or more, said method comprising the steps of:

screening iron ore to be supplied to a second granulator by a screen mesh of 0.5 to 10 mm, pulverizing the iron ore below the screen, adjusting the pulverized iron ore so that grains under 500 μm become 90 mass % or more and grains under 22 μm become 80 mass % or more, supplying the adjusted pulverized iron ore to said second granulator, granulating the adjusted pulverized iron ore in the presence of moisture to produce P-type granules, and supplying the iron ore on the screen together with the remainder of the pulverized iron ore not supplied to said second granulator, to a first granulator, and granulating the iron ore on the screen together with the remainder of the pulverized iron ore not supplied to said second granulator in said first granulator to produce S-type granules having fine powder adhered to coarse grains.

7. A method for pretreating a sintering material as set forth in claim 6, further including the step of changing the size of said screen mesh in accordance with the average stuck thickness of fine powder of said S-type granules to make said average stuck thickness of the fine powder within a desired predetermined range.

8. A method for pretreating a sintering material as set forth in claim 6, further including the step of changing the size of said screen mesh thereby changing the amount of the iron ore below said screen supplied to said second granulator to produce P-type granules.

9. A method for pretreating a sintering material comprising at least two types of iron ore containing coarse grains and fine powder, wherein the at least two types of iron ore each has a water of crystallization content of 3 mass % or more, said method comprising the steps of:

producing S-type granules using said coarse grains as core grains and an amount of said fine powder in a first granulator, wherein said amount of said fine powder is adjusted so that the S-type granules have an average stuck thickness of fine powder to the core grains of 50 to 300 μm, producing P-type granules using the remaining fine powder not supplied to said first granulator using a second granulator by a method comprising pulverizing the material for the second granulator and adjusting the material so that grains under 500 μm become 80 mass % or more and grains under 22 μm become over 70 mass % to 80 mass %, and granulating the grains in the presence of moisture in the second granulator, followed by drying the granules.

10. A method for pretreating a sintering material as set forth in claim 9, wherein a drying temperature of said P-type granules is from 40° C. to 250° C.

11. A method for pretreating a sintering material comprising at least two types of iron ore containing coarse grains and fine powder, wherein the at least two types of iron ore each has a water of crystallization content of 3 mass % or more, said method comprising the steps of:

producing S-type granules using an amount of said coarse grains as core grains and an amount of said fine powder in a first granulator, wherein said amount of said coarse grains is adjusted so that the S-type granules have an average stuck thickness of fine powder to the core grains of 50 to 300 μm, and producing P-type granules using the remaining fine powder in a second granulator by a method comprising pulverizing material for the second granulator, adjusting the material so that grains under 500 μm become 80 mass % or more and grains under 22 μm become over 70 mass % to 80 mass %, and granulating the grains in the presence of moisture in the second granulator, followed by drying the granules.

12. A method for pretreating a sintering material comprising at least two types of iron ore containing coarse grains and fine powder, wherein the at least two types of iron ore each has a water of crystallization content of 3 mass % or more, said method comprising the steps of:

screening iron ore to be supplied to a second granulator by a screen mesh of 0.5 to 10 mm, pulverizing the iron ore below the screen, adjusting the pulverized iron ore so that grains under 500 μm become 80 mass % or more and grains under 22 μm become over 70 mass % to 80 mass %, supplying the adjusted pulverized iron ore to said second granulator, granulating the adjusted pulverized iron ore in the presence of moisture to produce P-type granules, and supplying the iron ore on the screen together with the remainder of the pulverized iron ore not supplied to said second granulator to a first granulator, and granulating the iron ore on the screen together with the remainder of the pulverized iron ore not supplied to said second granulator in said first granulator, followed by drying the granules to produce S-type granules having fine powder adhered to coarse grains.

13. A method for pretreating a sintering material comprising at least two types of iron ore containing coarse grains and fine powder, wherein the at least two types of iron ore each has a water of crystallization content of 3 mass % or more, said method comprising the steps of:

screening iron ore to be supplied to a second granulator by a screen mesh of 0.5 to 10 mm, pulverizing the iron ore below the screen, adjusting the pulverized iron ore so that grains under 500 μm become 40 mass % or more and grains under 22 μm become 5 mass % to 70 mass %, supplying the adjusted pulverized iron ore to said second granulator, granulating the adjusted pulverized iron ore in the presence of moisture and a binder to produce P-type granules, and supplying the iron ore on the screen together with the remainder of the pulverized iron ore not supplied to said second granulator to a first granulator, and granulating the iron ore on the screen together with the remainder of the pulverized iron ore not supplied to said second granulator in said first granulator, followed by drying the granules to produce S-type granules having fine powder adhered to coarse grains.

14. The method for pretreating a sintering material of claim 13, wherein the step of granulating the iron ore on the screen together with the remainder of the pulverized iron ore comprises adjusting an amount of the coarse grains or an amount of the fine powder so that the S-type granules have an average stuck thickness of fine powder to the coarse grains of 50 to 300 μm.

* * * * *